US006078292A

United States Patent [19]

Koyanagi et al.

[11] Patent Number: 6,078,292

[45] Date of Patent: Jun. 20, 2000

[54] SMALL-SIZED WIRELESS DEVICE

[75] Inventors: Yoshio Koyanagi; Tsukasa Takahashi, both of Kanagawa; Koichi Ogawa, Osaka, all of Japan

[73] Assignee: Matsushita Electric Industrial Co., Ltd., Osaka, Japan

[21] Appl. No.: 08/949,112

[22] Filed: Oct. 10, 1997

[30] Foreign Application Priority Data

Oct. 14, 1996 [JP] Japan ..... 8-270864

[51] Int. Cl.[7] ..... H01Q 1/24

[52] U.S. Cl. ..... 343/702; 455/90; 455/128

[58] Field of Search ..... 343/702; 455/89, 455/90, 121, 128

[56] References Cited

U.S. PATENT DOCUMENTS

| | | | |
|---|---|---|---|
| 5,005,461 | 4/1991 | Murata | 84/646 |
| 5,253,292 | 10/1993 | Fluder et al. | 379/426 |
| 5,475,752 | 12/1995 | Mischenko | 379/433 |
| 5,708,445 | 1/1998 | Moller et al. | 343/702 |
| 5,918,186 | 6/1999 | Liu | 455/90 |

FOREIGN PATENT DOCUMENTS

| | | |
|---|---|---|
| 53-60625 | 5/1978 | Japan . |
| 58-134693 | 8/1983 | Japan . |
| 1-157398 | 10/1989 | Japan . |

*Primary Examiner*—Don Wong
*Assistant Examiner*—Hoang Nguyen
*Attorney, Agent, or Firm*—Pearne & Gordon LLP

[57] ABSTRACT

A small-sized wireless device has a whip antenna and a receiver for receiving a call. The whip antenna is provided at the upper side of the rear face of the small-sized wireless device body to improve the antenna performance in a state where a person holds the body to communicate. A rib is provided at a portion of the rear face of the small-sized wireless device body in order to prevent the degradation of the antenna characteristics of the whip antenna at the time of placing the small-sized wireless device body on a metal plate and the like. According to such an arrangement, good sensitivity of the whip antenna can be obtained even when the small-sized wireless device body is placed on a metal plate.

9 Claims, 6 Drawing Sheets

SMALL-SIZED WIRELESS DEVICE

BACKGROUND OF THE INVENTION

The present invention mainly relates to a portable small-sized wireless device and, particularly to a technique for improving the receiving sensitivity of a whip antenna.

Recently, the demand has been increased abruptly as to a mobile wireless device such as a-cellular phone, a PHS, a PCS or the like.

A whip antenna capable of being retracted within the body of a telephone has been known as an antenna for a conventional portable telephone.

FIG. 7 is a front view showing the configuration of a conventional small-sized wireless device. As shown in FIG. 7, a whip antenna 71 is used as an antenna serving both as a receiving and transmitting antenna retracted within a small-sized wireless device body 72, and is usually provided at the upper portion of the rear face of the small-sized wireless device body 72 so as to obtain good performance in a state where a person uses the apparatus using a receiver 73. As a result, it is possible to perform high-quality and stable mobile communication.

According to the increase of the market for the mobile communication such as a cellular phone, a PHS, a PCS or the like, smaller-size goods with better performance have been demanded.

Recently, the main body of the telephone has become thinner due to the miniaturization thereof. Accordingly, the whip antenna 71 has become closer to the receiver 73 as shown by the using state of the telephone in FIG. 8. Accordingly, the distance between the whip antenna 71 and the head portion 74 of a human body tends to become shorter at the time when a person holds the telephone and abuts the telephone against his ear in use.

However, it has been known that when the whip antenna 71 approaches the head portion 74 of a human body, the head portion 74 which is dielectric substance of high permittivity absorbs radio wave, so that both the antenna performance and the communication quality degrade.

FIG. 9 is a graph showing the relation between the distance D [mm] between the position of the whip antenna 71 and the head portion 74 of a human body and the radiation gain of the antenna. It is understood from the figure that the shorter the distance D [mm] (abscissa) is, the more remarkably the radiation gain of the antenna (ordinate) degrades. In this regard, the degree of the degradation due to the head portion 74 of a human body is larger in the retracted state of the whip antenna 71 within the main body (symbol X) as compared with the extended state of the antenna (symbol of black rectangular).

Accordingly, in recent years, although the small-sized wireless device body 72 becomes thinner, the whip antenna 71 is disposed at a portion as closer as possible to the rear surface of the main body so that the distance between the whip antenna and the head portion 74 of a human body becomes longer.

However, if the small-sized wireless device is designed in the above manner, the antenna is very close to the surface of a desk or the like on which the portable small-sized wireless device is placed when it is laid on its rear face on the desk so as to wait to receive a call. Accordingly, the receiving sensitivity of the antenna will be degraded remarkably when the portable apparatus is placed on a metal desk such as a steel desk.

In particular, in the case of a thin rod-shaped cellular phone, the cellular phone is likely laid on a desk to wait to receive a call while its display surface 75 of an LCD (liquid crystal display) is turned upward as shown in FIG. 10. In this case, when the cellular phone is placed on a metal desk such as a steel desk, a metal plate 76 of the desk is close to the whip antenna 71. Consequently, a current I' [mA] whose phase is in opposite to a current I [mA] on the whip antenna 71 flows on the surface of the metal plate due to the mutual coupling of the metal plate and the whip antenna. As a result, there arises a problem that, the radiation direction characteristic of the whip antenna 71 changes and the impedance characteristic thereof changes greatly, whereby the matching state of the antenna is broken and so the radiation gain is degraded.

SUMMARY OF THE INVENTION

It is an object of the present invention to provide a small-sized wireless device capable of performing high-quality and stable mobile communication in which the small-sized wireless device is configured in a manner that, in view of the characteristic in a state where a person uses the wireless device, the whip antenna is not close to the surface of a metal desk when it is placed on the desk although the whip antenna is disposed at the rear face of the main body of the small-sized wireless device.

In order to achieve the aforesaid object, the small-sized wireless device according to the present invention comprises a whip antenna disposed at the upper portion of the rear face of the main body of the small-sized wireless device, and a rib disposed at the rear face of the main body of the small-sized wireless device for adjusting the sensitivity characteristic of the whip antenna when the main body is laid on its rear face on a metal plate, wherein the rib is disposed at such a balanced position that the upper side of the main body of the small-sized wireless device is floated when the main body of the small-sized wireless device is laid. According to such a configuration, it is possible to obtain good receiving sensitivity even when the main body is laid on a metal plate.

Further, since the rib is disposed on a detachable and exchangeable battery pack, it is possible to obtain good receiving sensitivity even when arbitrary one of various types of battery packs is mounted in the main body and the main body is laid on a metal plate.

PREFERRED EMBODIMENTS OF THE INVENTION

Preferred embodiments according to the present invention will be described referring to the accompanying drawings.

The present invention is provided with a whip antenna disposed at the upper portion of the rear face of the main body of the small-sized wireless device, and a rib disposed at the rear face of the main body of the small-sized wireless device for adjusting the sensitivity characteristic of the whip antenna when the main body of the small-sized wireless device is laid on its rear face on a metal plate, wherein the rib is disposed at such a balanced position that the upper side of the main body of the small-sized wireless device is floated when the main body of the small-sized wireless device is laid on its rear face on the plate. According to such a configuration, the present invention has a function that it is possible to obtain good receiving sensitivity even when the main body is laid on a metal plate.

Further, since the rib is disposed on a detachable and ex changeable battery pack, it is possible to obtain good receiving sensitivity even when arbitrary one of various types of battery packs is mounted in the main body and the main body is laid on its rear face on a metal plate.

Respective embodiments for carrying out the present invention will be explained with reference to FIGS. 1 to 6.

First Embodiment

Figure 1:
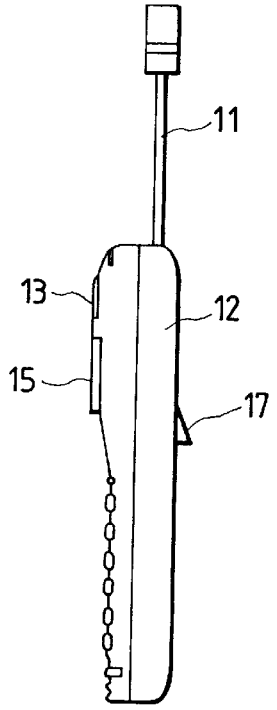
FIG. 1 is a side view showing the arrangement of the small-sized wireless device according to the first embodiment of the present invention.

FIG. 1 is a side view showing the arrangement of a small-sized wireless device according to a first embodiment of the present invention. In this case, a small-sized wireless device is one of a rod-shape.

FIG. 1 is a side view of a small-sized wireless device body 12 having an extensible whip antenna 11 capable of being retracted within the small-sized wireless device body 12 and a receiver 13 for receiving a call. In this drawing, the left side is the front face of the main body and the right side is the rear face of the main body. The whip antenna 11 is disposed, in order to improve the performance of the antenna, at a portion as closer as possible to the rear surface of the small-sized wireless device body 12 such that the distance between the whip antenna and the head portion of a human body becomes longer in a state where a person holds the wireless device and abuts the receiver 13 against his ear for communication.

A rib 17 is provided at the rear face of the main body so as to float the upper portion of the main body in a manner that the whip antenna 11 is not close to the surface of a metal plate such as a steel desk when the small-sized wireless device body 12 is laid on the metal plate. The advantages according to such a configuration is that the degradation of the characteristics of the antenna can be prevented at the time of placing the wireless device on a metal plate, and also that a person can view the display surface 15 of a LCD more easily since the display surface is placed in a slanted state.

However, since a small-size, light-weight and thin design has been preferred recently, the height of the projection such as a rib 17 is required to be limited to a value as small as possible. Therefore, it is required to select a most suitable setting point of the rib in view of the weight balance of the small-sized wireless device body 12 so that the maximum effects can be obtained with the required minimum height of the rib 17.

Figure 2:
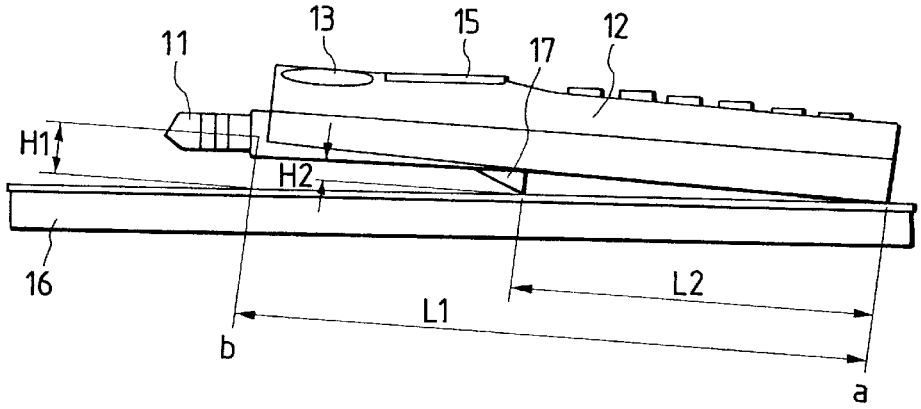
FIG. 2 is a side view for explaining a state in which the small-sized wireless device shown in FIG. 1 is used on a metal plate.

FIG. 2 is a diagram for explaining a state in which the small-sized wireless device body 12 is used on the metal plate 16. This drawing is a side view of the small-sized wireless device showing a state in which the small-sized wireless device with the arrangement of FIG. 1 is laid on the metal plate 16 such as a steel desk such that the display surface 15 of the LCD is laid to be turned upward. In this drawing, portions corresponding to those of FIG. 1 are referred to by the same symbols.

When the distance L1 from the lower end portion a of the small-sized wireless device body 12 to the base portion b of the whip antenna 11 and the distance L2 from the lower end portion a of the small-sized wireless device body 12 to the rib 17 are sufficiently larger than the height H2 of the rib 17, the height H1 from the metal plate 16 to the antenna base portion b will be represented by the following expression.

$$H1 = H2 \times L1/L2 \quad (1)$$

In this case, the rib 17 is disposed, according to the weight balance of the small-sized wireless device body 12 and in view of the principle of a lever in which the rib 17 serves as a fulcrum, at such a position that the whip antenna 11 side of the small-sized wireless device body is floated.

Assuming that the weight distribution of the small-sized wireless device body is uniform, when the rib 17 is disposed at a position slightly upper side from the longitudinal center position of the small-sized wireless device body 12, L1/L2 is about 2. As a consequence, since the height H1 of the base portion b of the antenna can be made about twice the height H2 of the rib 17, the antenna base portion b can be separated from the metal plate 16.

In other words, the desired distance from the metal plate can be obtained by providing the rib 17 with a half height of the originally required height at the small-sized wireless device body 12, so that it becomes possible to limit the height of the projection to a small value.

Figure 3:
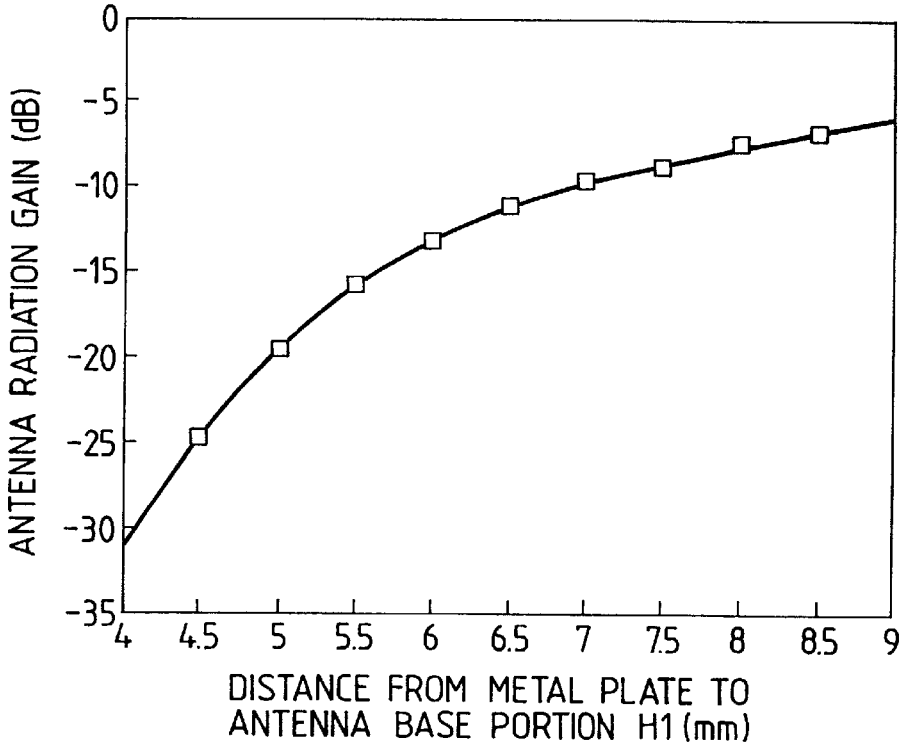
FIG. 3 is a diagram showing the characteristic of an antenna when the small-sized wireless device shown in FIG. 2 is used on a metal plate.

FIG. 3 shows the antenna characteristics when the small-sized wireless device is used on a metal plate as shown in FIG. 2, in which the abscissa represents the distance H1 from the metal plate to the antenna base portion b and the ordinate represents the antenna radiation gain of the whip antenna 11.

It is understood from this figure that the larger the distance from the metal plate to the base portion of the antenna is, that is, the large the height H1 is, the more the antenna gain is improved.

For example, the antenna radiation gain is −24 [dB] when the height H1 is 4.5 mm. However, when the height H1 is increased by 3 mm to be 7.5 mm, the antenna radiation gain is —8 [dB], that is, the antenna radiation gain is improved by about 16 [dB].

Second Embodiment

Figure 4:
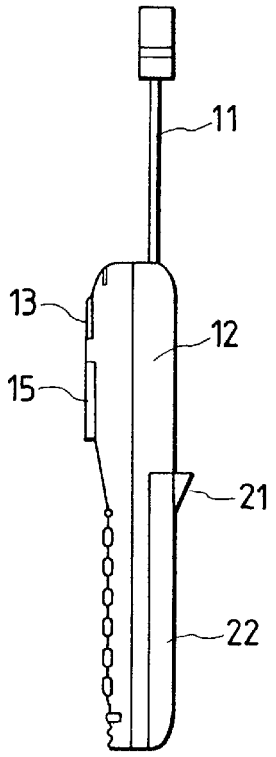
FIG. 4 is a side view showing the arrangement of the small-sized wireless device according to the second embodiment of the present invention.

FIG. 4 is a side view showing the arrangement of the small-sized wireless device according to the second embodiment of the present invention. In this case, the small-sized wireless device is one of a rod-shape. In this drawing, the portions corresponding to those of FIG. 1 are referred to by the same symbols.

FIG. 4 is a side view of the small-sized wireless device body 12 having an extensible whip antenna 11 capable of being retracted within the small-sized wireless device body and a receiver 13 for receiving a call. In this drawing, the left side is the front face of the main body and the right side is the rear face of the main body. The whip antenna 11 is disposed, in order to improve the performance of the antenna, at a portion as closer as possible to the rear surface of the small-sized wireless device body 12 such that the distance to the whip antenna from the head portion of a human body becomes longer in a state where a person holds the wireless device and abuts the receiver 13 against his ear for communication. The main body also has a detachable battery pack 22 so that the kind of the battery pack can be changed in accordance with the capacity of the battery.

A rib 21 provided at the rear face of the main body is disposed on the battery pack 22 so as to float the upper portion of the main body in a manner that the whip antenna 11 is not close to the surface of a metal desk when the small-sized wireless device body 12 is laid on its rear face on the metal plate. The advantages according to such a configuration is that the degradation of the antenna characteristics can be prevented at the time of placing the wireless device on a metal plate, and also that a person can view the display surface 15 of a LCD more easily since the display surface is placed in a slanted state.

Figure 5:
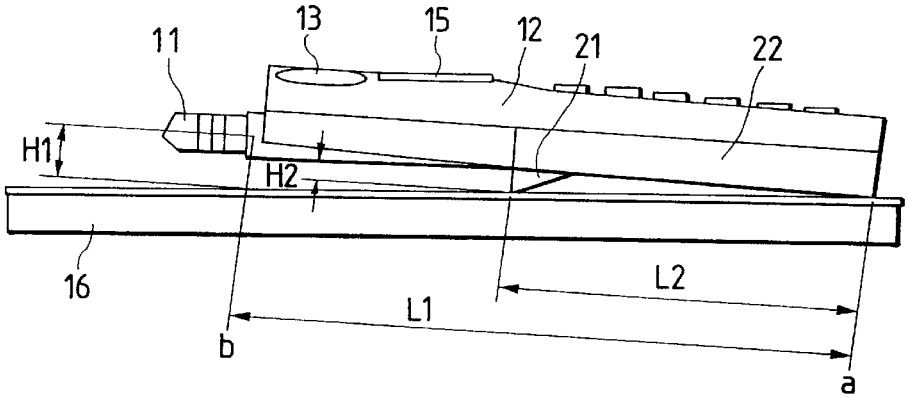
FIG. 5 is a side view for explaining a state in which the small-sized wireless device shown in FIG. 4 is used on a metal plate.

FIG. 5 is a diagram for explaining the state where the small-sized wireless device body 12 used on a metal plate 16 like FIG. 2. This drawing is a side view of the small-sized wireless device body showing a state that the small-sized wireless device with the arrangement of FIG. 4 is laid on the metal plate 16 such as a steel desk such that the display surface 15 of the LCD is laid so as to be turned upward. In this drawing, portions corresponding to those of FIG. 2 are referred to by the same symbols.

In this case, the rib 21 is disposed, according to the weight balance between the small-sized wireless device body 12 and the battery pack 22 and in view of the principle of a lever in which the rib serves as a fulcrum, at such a position that the whip antenna side of the main body is floated. In general, since the specific gravity of the battery pack is large than that of the small-sized wireless device body, it is possible to float the whip antenna side of the main body so long as the rib 21 is positioned at the upper side of the center of the gravity of the main body even if the rib is positioned at the lower side of the longitudinal center portion of the small-sized wireless device body 12.

The center of the gravity of the main body changes depending on the size and weight of the battery pack 22. Further, the height H2 of the rib 21 necessary for floating the base portion of the whip antenna by the desired height changes depending on the size and weight of the battery pack. Accordingly, it becomes possible to set the most suitable rib 21 according to the respective kinds of the batteries by providing the rib 21 at the battery pack 22.

Figure 6A:
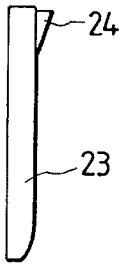
FIGS. 6A to 6C are diagrams showing the concrete arrangements of a rib in the second embodiment of the present invention.
Figure 6B:
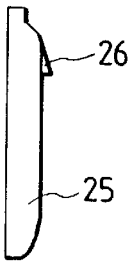
Figure 6C:
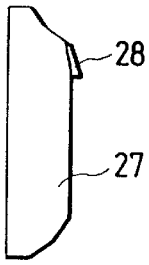
Figure 7:
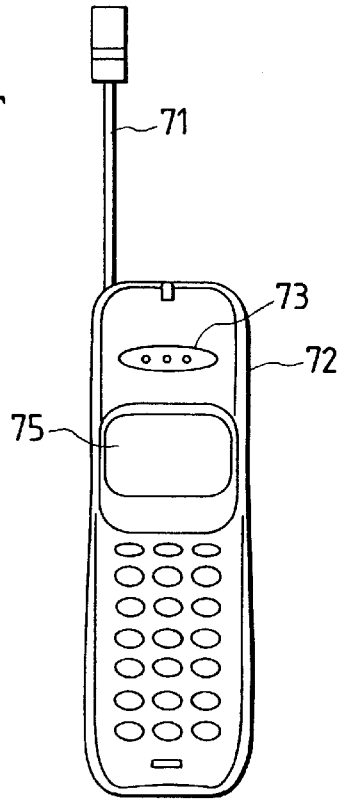
FIG. 7 PRIOR ART
FIG. 7 is a front view showing the arrangement of a conventional small-sized wireless device.
Figure 8:
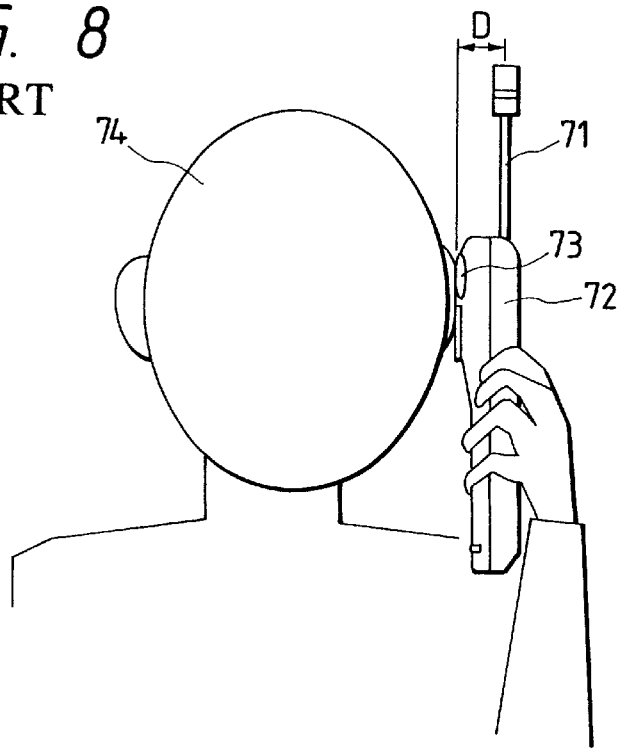
FIG. 8 PRIOR ART
FIG. 8 is a diagram for explaining a state where a person holds and uses the conventional small-sized wireless device.
Figure 9:
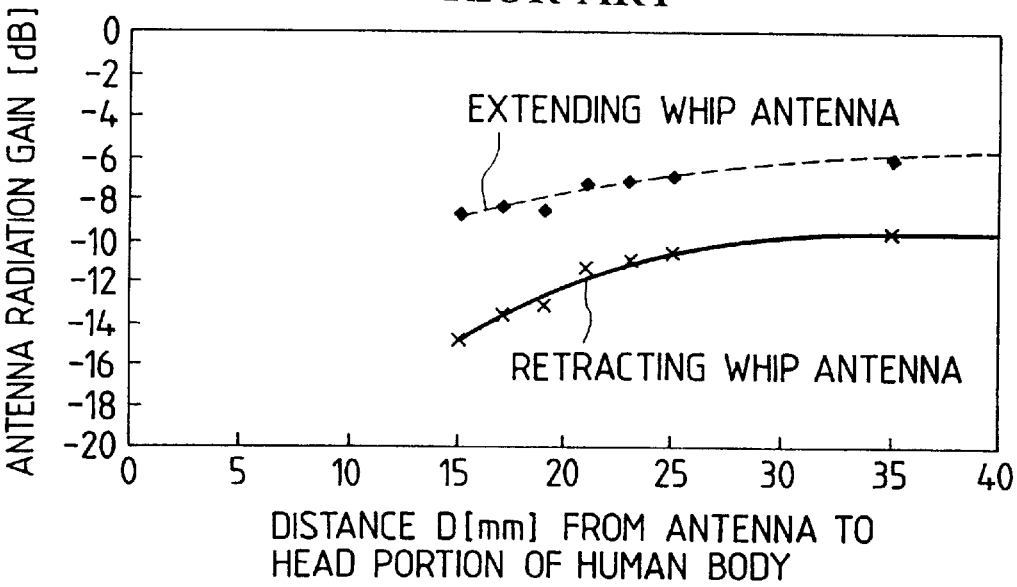
FIG. 9 PRIOR ART
FIG. 9 is a diagram for showing the characteristic of an antenna when a person holds and uses the conventional small-sized wireless device.
Figure 10:
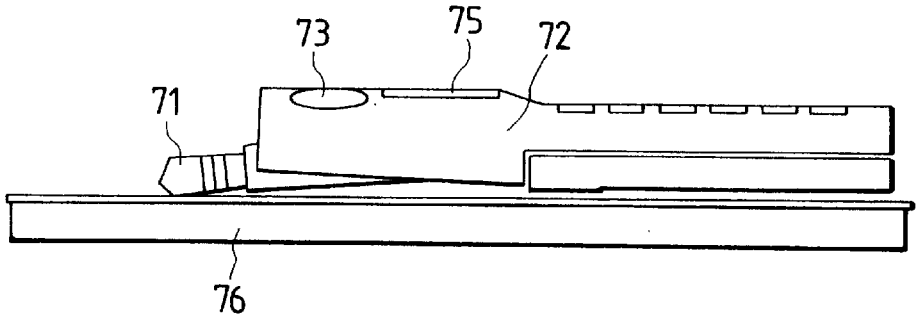
FIG. 10 PRIOR ART
FIG. 10 is a diagram for explaining a state in which the conventional small-sized wireless device is used on a metal plate.

FIGS. 6A to 6C show arrangements of the ribs used in the second embodiment according to the present invention. FIG. 6A shows a case in which a rib 24 is provided at an S-size battery pack 23 with a small capacity. This battery pack is same as that used in the state of FIG. 5.

FIG. 6B shows a case in which a rib 26 is provided at an M-size battery pack 25 with an intermediate capacity. In this case, since the weight of the battery portion becomes larger as compared with the state of FIG. 5, the rib 26 can be disposed at a position slightly lower than the upper portion of the main body in view of the entire weight balance of the small-sized wireless device, and hence the height of the rib 26 can be made lower according to the lowering of the rib position. Further, in this case, since the thickness of the battery portion is larger than the case where the S-size battery pack 23 is mounted, the whip antenna portion is originally lifted without the rib by a length corresponding to the larger height of the M-size battery pack, so that it is possible to lower the height of the rib 26 necessary for lifting the base portion of the whip antenna by the desired height.

FIG. 6C shows a case in which a rib 28 is provided at an L-size battery pack 27 with a large capacity. In this case, since the weight and the thickness of the battery portion becomes larger as compared with the case of FIG. 6B, it is possible to make the height of the rib 28 lower by a length corresponding to the larger height of the L-size battery pack. According to circumstance, it is possible to lift the base portion of the whip antenna by the desired height without the rib 28.

Third Embodiment

Figure 11:
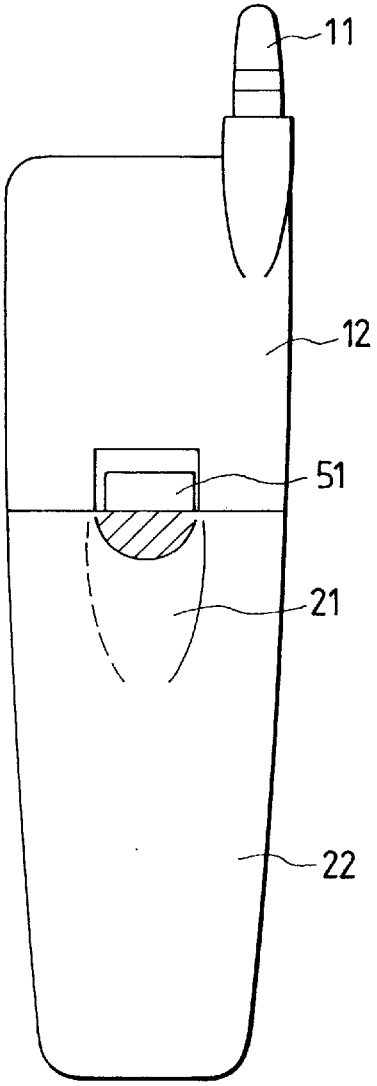
FIG. 11 is a back view of a small-sized wireless device according to a third embodiment according to the present invention.
Figure 12:
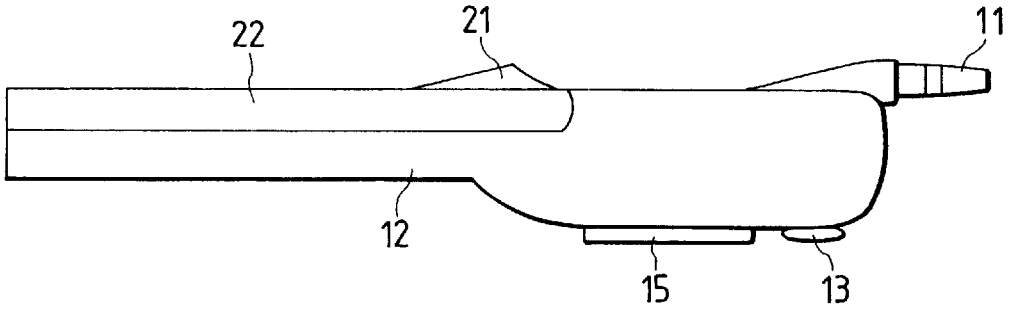
FIG. 12 is a side view of the small-sized wireless device according to the third embodiment according to the present invention.

Next, third embodiment according to the present invention will be described in detail. FIG. 11 is a back view of a small-sized wireless device according to a third embodiment according to the present invention; and FIG. 12 is a side view of the small-sized wireless device according to the third embodiment according to the present invention. In the drawings, the portions corresponding to those of FIG. 1 are referred to by the same symbols.

A small-sized wireless device shown in FIG. 11 has a nail portion 51 for fitting a battery pack 22 on a body portion 12. The battery pack 22 has a connecting member (not shown) at a portion corresponding to the nail portion 51. The connecting member is engaged with the nail portion 51 so that the battery pack 22 is fitted on a body portion 12. When the battery pack 22 is removed from the body portion 12, the nail portion 51 is moved in an upper direction of the drawing so that the connection of the connecting member and the nail portion 51 is unlocked to remove the battery pack 22 from the body portion 12.

In this occasion, preferably, a rib 21 does not have the side shape of the substantially right triangle but is provided so that the rib also has a gentle inclination in the direction to the nail portion 51. Accordingly, the nail portion 51 is easily operated.

As described above, according to the present invention, in the rod-shaped small-sized wireless device for mobile communication, since the rib is provided at the rear surface of the small-sized wireless device body, the antenna radiation characteristics of the whip antenna can be controlled in the case where the small-sized wireless device body is laid on its rear surface on a metal plate. Accordingly, the advantages can be obtained that good receiving sensitivity is realized and high-quality and stable mobile communication is made possible.

What is claimed is:

1. A small-sized wireless device comprising:

a main body having a rear face, said main body including a detachable and exchangeable battery pack having a rear surface, said rear surface comprising at least a portion of the rear face of the main body;

a whip antenna disposed at an upper portion of the rear face of said main body; and a rib for adjusting sensitivity characteristic of the whip antenna when said main body is laid on a metal member, said rib being fixed to the rear surface of the battery pack;

wherein said rib is disposed at a balanced position such that an upper part of said main body is spaced from said metal member when said main body is laid on said metal member.

2. A small-sized wireless device according to claim 1, wherein said rib is disposed at a position slightly upward from a longitudinal center position of said main body.

3. A small-sized wireless device according to claim 1, wherein the rib has a triangular cross section.

4. A small-sized wireless device according to claim 1, wherein a lower part of said main body contacts said metal member when said main body is laid on said metal member.

5. A small-sized wireless device comprising:

a main body having a rear face;

a whip antenna having a base disposed at an upper portion of the rear face of the main body; and a rib for improving a receiving sensitivity of the whip antenna when the main body is laid on a metal surface, said rib being disposed on the rear face of the main body and extending a fixed first distance from the rear face, said rib being positioned along the length of the main body and having a configuration such that when the main body is laid on the surface, a lower part of the main body contacts the surface and the base of the whip antenna is spaced a second distance from the surface, thereby improving the receiving sensitivity of the whip antenna.

6. The small-sized wireless device of claim 5, wherein the second distance is about twice the first distance.

7. The small-sized wireless device of claim 5, wherein the main body comprises a detachable and exchangeable battery pack having a rear surface that comprises at least a portion of the rear face of the main body, and wherein the rib is fixed to the rear surface of the battery pack.

8. The small-sized wireless device of claim 5, wherein the rib is disposed at a position slightly upward from a longitudinal center position of the main body.

9. The small-sized wireless device of claim 5, wherein the rib has a triangular cross section.

* * * * *